United States Patent [19]

Dickey et al.

[11] Patent Number: 4,712,372

[45] Date of Patent: Dec. 15, 1987

[54] OVERSPEED SYSTEM REDUNDANCY MONITOR

[75] Inventors: Thomas A. Dickey, Westport; George R. Bodetka, Stamford, both of Conn.

[73] Assignee: Avco Corporation, Stratford, Conn.

[21] Appl. No.: 777,118

[22] Filed: Sep. 18, 1985

[51] Int. Cl.[4] ..... F02C 9/00

[52] U.S. Cl. ..... 60/39.281; 324/160

[58] Field of Search ..... 60/39.091, 39.281, 39.24; 324/160, 161; 364/184, 185, 186

[56] References Cited

U.S. PATENT DOCUMENTS

| | | | |
|---|---|---|---|
| 3,937,014 | 2/1976 | Plant | 60/39.281 |
| 3,987,620 | 10/1976 | Giordano et al. | 60/39.281 |
| 4,058,975 | 11/1977 | Gilbert et al. | 60/39.281 |
| 4,251,873 | 2/1981 | Joby | 364/184 |
| 4,528,812 | 7/1985 | Cantwell | 60/39.281 |

*Primary Examiner*—Louis J. Casaregola
*Attorney, Agent, or Firm*—Ralph D. Gelling; M. E. Frederick

[57] ABSTRACT

A redundancy monitor is presented which makes operational checks on the electronic overspeed control system used on aircraft turbine engines. The monitor is a small and lightweight device that can be permanently installed on the engine. Its function is to monitor both the speed pickups that count the revolutions per minute that the turbine shaft is turning and at the same time maintain a check on the performance of the circuitry which processes the data. The monitor includes a latching type BITE indicator which signifies redundant status of the speed pickups and a lamp which lights to indicate any failure in the output circuitry of the overspeed sensor system. A momentary-on type switch activates self test circuitry within the redundancy monitor.

4 Claims, 4 Drawing Figures

OVERSPEED SYSTEM REDUNDANCY MONITOR

I. BACKGROUND OF THE INVENTION

This invention pertains to a monitor for the overspeed protection system in a gas turbine engine.

In the prior art gas turbine engines, a mechanical overspeed governor was used. The purpose of the governor is to bypass fuel if engine speed exceeds some particular value. Usually this value has been 104% of rated engine rpm. In the mechanical overspeed governor, flyweights were used to operate a pilot valve controlling the servo fluid pressure to a power piston. This piston controls a bypass valve which shunts fuel away from the engine beginning at about 100.4 percent engine speed. As engine speed increases, the bypass valve opens further and, at 106 percent engine speed, fuel is completely bypassed from the engine.

Later, electronic engine overspeed controls replaced the mechanical overspeed governors and made it possible to increase reliability through the use of redundant speed sensors and associated circuitry. These sensors count teeth on gears placed in the power turbine bearing package. A fuel shut-off valve is actuated by the overspeed controller when an overspeed condition is sensed. To insure the increased reliability of the redundant speed pickups, it is necessary to conduct periodic checks of the multiple speed sensors at intervals of 100 to 200 flights. With the prior art electronic overspeed system, these tests are made in the following way. The aircraft is moved to a maintenance engine run-up area and a hand held test set is connected to each engine. The engine must then be started and run at a speed sufficient to actuate the speed sensing system, that is a fan speed between 35% and 50% of rated speed. This procedure is expensive in manpower, requires personnel to be exposed to engines operating above the ground idle condition, causes additional starts and decreases aircraft availability. These costs are largely eliminated by the addition of the overspeed monitor which we have invented. Our overspeed monitor is small, lightweight and is installed on the engine at all times. It monitors the function of the speed pickups throughout every flight and when inspected visually, with the engine shutdown, indicates the performance of the overspeed control system throughout the previous flight. With our invention, the ground run-up inspection procedure is eliminated. A static hangared inspection requires less time than an oil level check.

SUMMARY OF THE INVENTION

It is an object of this invention to reduce the number of periodic performance checks that have to be made on the overspeed protection system of an aircraft turbine engine. Without this invention, it is necessary to make an operational check typically every 35 flights and a more complete redundancy check typically every 100 to 200 flights. With this invention, time and costs are saved since the redundancy checks may be made without a costly engine run-up.

The redundancy monitor of this invention checks the redundant features of the electronic overspeed control system and can be visually inspected with the engine shutdown. Visual inspection of the monitor signifies the operational performance status of the entire overspeed system during the course of previous flights. The monitor operates during normal flight operation and does not require a separate test operation.

The redundancy monitor accomplishes its task by analyzing signals made available at a test receptacle connected into the overspeed system circuitry. Three voltage sources are made available at the test receptacle. One of these is a 28 vdc power source. Thus, whenever electric power is turned on for the engine, there will be 28 vdc power available to operate the redundancy monitor.

Second, the speed sensor signal voltage is connected to the test receptacle. This signal is the output of the circuitry which senses the speed at which the turbine shaft is turning. There are dual pickup sensors and whenever the turbine engine is turning at speeds greater than one quarter rated rpm, a 3 volt square wave will be generated whose repetition rate is proportional to engine speed. The 3 volt input test signal is present only when both pickups and their associated circuits are functioning properly. When the engine is stopped or when there is a fault in the speed sensing circuitry, the input test signal drops to zero.

Third, the test receptacle receives a dc voltage signal from the dual circuits that power the overspeed shutdown fuel valve. When both circuits are functioning properly, this signal has a value of approximately 17 vdc. If there is a failure in one of the output circuits, the output test signal will rise above 18 vdc. A failure in the other circuit causes the output test signal to drop to the vicinity of 15.5 vdc.

The redundancy monitor utilizes the 28 vdc prime power to energize its circuitry. The output test signal from the overspeed controller is fed in parallel to a pair of comparators within the redundancy monitor, the test signal being connected to the plus pin of one comparator and the minus pin of the second comparator. A resistance divider network across the 28 vdc power source then is used to supply reference voltages to the second input of each comparator, 17.97 vdc to the plus pin of one and 15.76 vdc to the minus pin of the other. The outputs of the two comparators are tied together and when either switches state, it will cause a lamp bulb to light. Since the comparators will switch state only when the signal from the dual shutdown valve circuit swings above or below the reference limits of the voltages supplied by the resistance divider network, the lamp remains unlighted unless a malfunction occurs in one of the circuits which powers the overspeed shutdown fuel valve.

A second task of the redundancy monitor is to check on the presence of a speed sensor signal. This signal consists of a 3 volt square wave if the turbine engine is running at a nominal rate of speed and both speed sensing circuits are receiving and processing data. When the engine stops or when there is a fault, the speed input test signal drops to zero. The second channel of the redundancy monitor acts on this information to activate a BITE indicator. A manually reset BITE indicator is used which provides a visual indication of speed sensor signal presence. When reset to black the BITE indicator is encircuited so that it will switch from black to white when the 3 volt square wave is present.

The monitor also incorporates a self test feature within its circuitry. A single pole double throw momentary-on switch connected into appropriate resistor divider networks is used to inject test voltages to actuate the redundancy monitor circuitry. The self test feature gives the operator confidence that the redundancy monitor is reliably reporting on the condition of the overspeed control system.

DESCRIPTION OF THE PREFERRED EMBODIMENT

Figure 1:
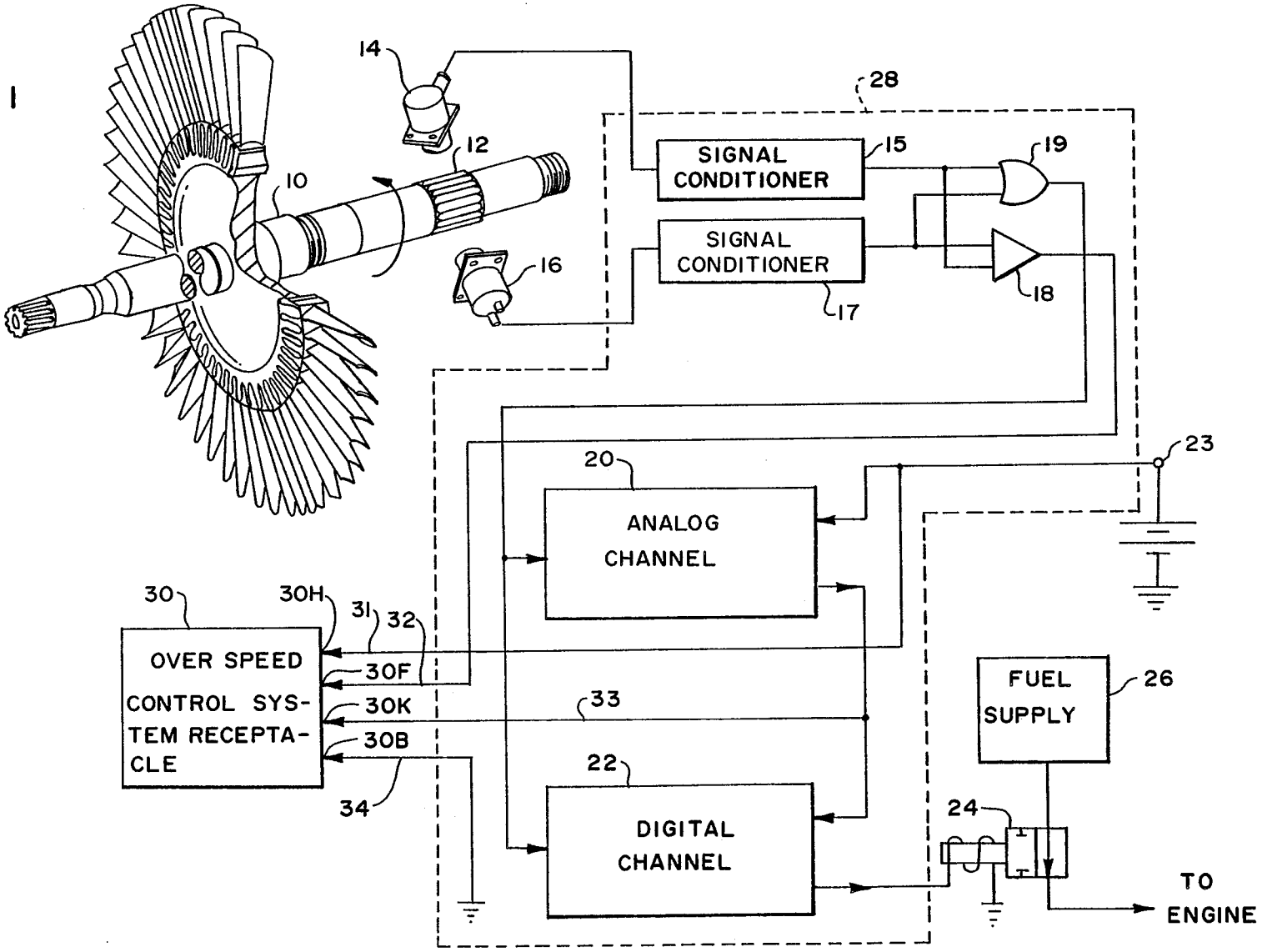
FIG. 1 is a block diagram of the entire turbine engine overspeed control system showing the relationship of the redundancy monitor to the overspeed control system.

The invention checks the redundant features of the overspeed control system of a turbine engine. FIG. 1 depicts in block diagram form the interrelation of the several components of the overspeed control system. The main turbine of the engine is shown mounted on shaft 10. One or more toothed gears 12 is fixedly attached to shaft 10 at a location adjacent the aft bearing support. Two pickups, 14 and 16, count the passage of teeth on gear 12 as the turbine wheel turns during engine operation. For example, if turbine shaft 10 rotated at 18,000 rpm and gear 12 had 20 teeth, the pulse rate at the pickups would be 6,000 pps.

The signal from pickup 14 is processed by signal conditioner 15 and the signal sensed by pickup 16 is processed by signal conditioner 17. The outputs from the two signal conditioners drive two gating circuits 18 and 19 in parallel. And-gate 18 will have an output only if both pickups and their associated signal conditioners are performing properly. Hence, the output from and-gate 18 provides one of the input test signals to redundancy monitor receptacle 30 on lead 32. This test signal has either of two values. If both pickups and their respective signal conditioners are working properly, the input test signal on lead 32 is a three volt square wave having a repetition rate proportional to the speed of the turbine. If one of the speed sensing circuits malfunctions, the output from and-gate 18 will be zero and so will the voltage appearing on lead 32.

The output of or-gate 19 drives analog channel 20 and digital channel 22 in parallel. There will be an output from the or-gate if either of the pickups and their respective signal conditioners are functioning properly. As implemented, the pulses out of or-gate 19 are of constant width and height. Hence, analog channel 20 can integrate the sum of all pulses received in a given time interval and arrive at a voltage value which is proportional to the speed at which the turbine is turning. Digital channel 22 has an easier task in that it has only to keep track of the number of pulses received as a function of time.

Within both channels 20 and 22 there is circuitry which provides a signal relative to a predetermined maximum speed and means to compare the actual speed signal in each channel with the maximum speed signal. When both analog channel 20 and digital channel 22 detect the overspeed condition, the solenoid operated fuel valve 24 is closed and the fuel flow is cutoff between fuel supply 26 and the engine. As implemented, both the analog and digital channels must detect the overspeed condition in order to actuate the fuel cutoff at fuel valve 24. This implementation precludes a failure in either channel from interrupting the fuel supply.

In combination, analog channel 20 and digital channel 22 provide a redundant sensing of the operating speed of the turbine. Both digital and analog signals indicative of an overspeed condition have to be present before the fuel supply is interrupted. A failure within either the pickups 14 and 16, signal conditioners 15 and 17 or channels 20 and 22 cannot shut off the fuel supply since the analog channel 20 and digital channel 22 must operate in series to energize solenoid valve 24. A signal relative to the operating status of analog channel 20 and digital channel 22 may be obtained from lead 33 which is subject to three different dc voltage levels. When both the analog and digital portions of the overspeed control system are functioning properly, lead 33 will be at a voltage level of 16.59 volts. If digital channel 22 malfunctions, the voltage on lead 33 rises above 17.97 volts. If analog channel 20 malfunctions, the voltage on lead 33 drops below 15.76 volts.

A receptacle 30 suitable for accepting a four pin plug is connected into the overspeed control system in accordance with this invention. The speed sensing signal of And-gate 18 is connected as shown in FIG. 1 to the pin 30F of receptacle 30 by lead 32. The 28 volt power source 23 is connected to pin 30H by lead 31. A signal indicative of proper operation of the analog and digital channels is connected to pin 30K of receptacle 30 through lead 33. A fourth pin 30B is connected to ground.

The operating condition of the overspeed control system is checked by the redundancy monitor 38 of this invention during normal flight operation. The redundancy monitor 38 is constructed with a plug 40 having four pins 40H, 40F, 40K and 40B which engage similar pins on receptacle 30.

Figure 2:
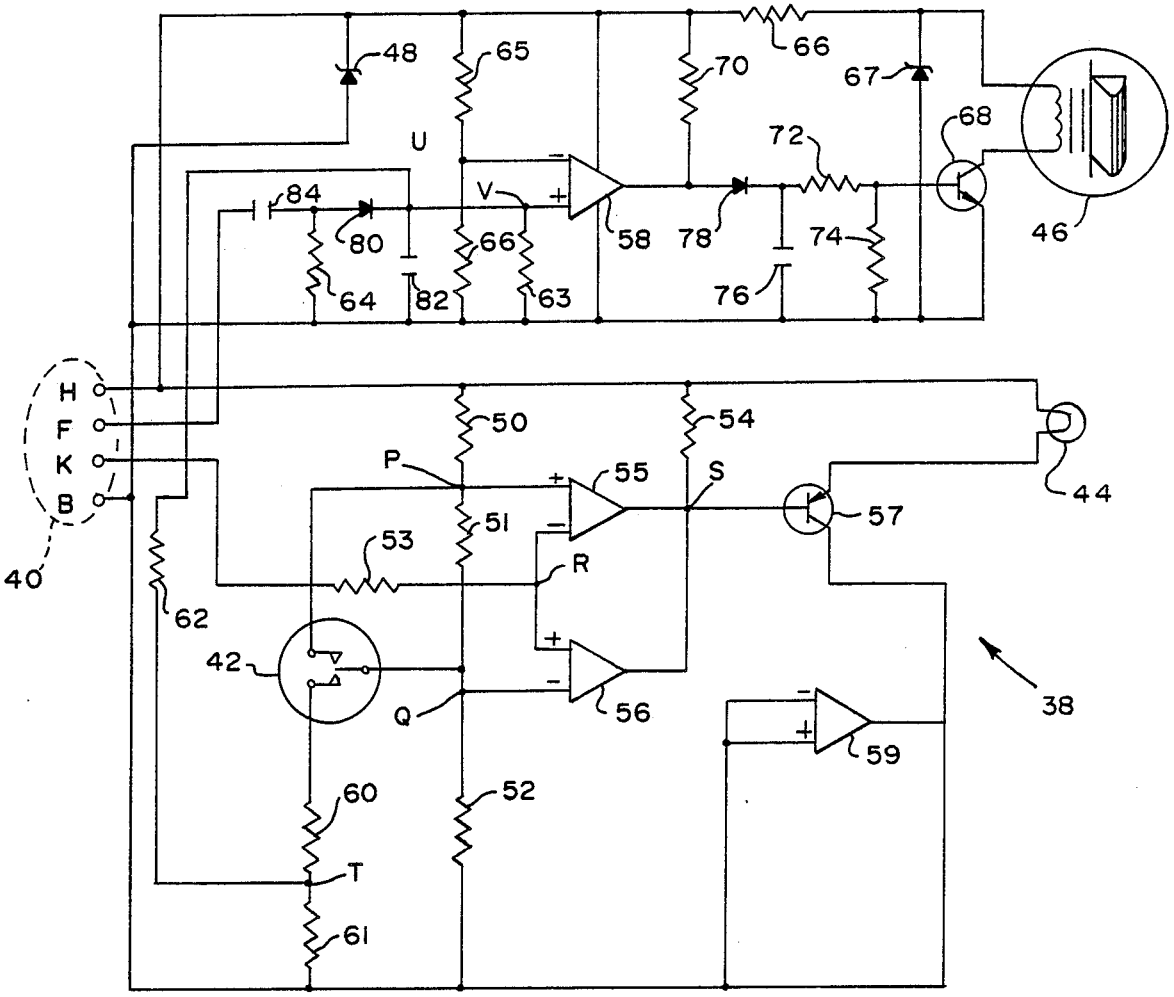
FIG. 2 is a schematic of the overspeed redundancy monitor.
Figure 3:
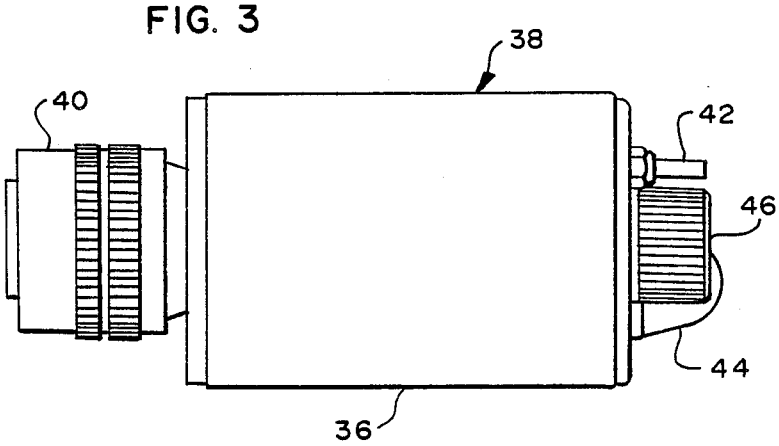
FIG. 3 is a side view of the overspeed redundancy monitor.
Figure 4:
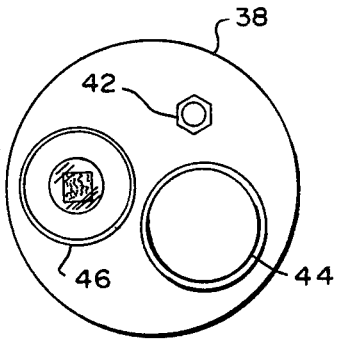
FIG. 4 is an end view of the overspeed redundancy monitor shown in FIG. 3 and including the test function readouts.

The overspeed redundancy monitor 30 is enclosed in a housing 36 as shown in FIG. 4 and is constructed with a connector plug 40 for engagement with the receptacle 30 of the overspeed control system. In FIG. 2, the connector 40 is shown to have pins 40H, 40F, 40K and 40B which engage the corresponding pins on receptacle 30 and receive the signals indicated in FIG. 1.

On the front face of the redundancy monitor there is a momentary-on test switch 42, an indicator lamp 44 and a latching type BITE indicator 46. The latching type BITE indicator 46 monitors for faults in the speed sensing circuitry 14, 15, 16 and 17 and indicator lamp 44 indicates any failures occurring in the circuits which power the fuel valve 24. The BITE indicator 46 is manually resettable and in operation will trip to a normal indication if no fault exits in the speed sensing system. In the present system indicator 46 will switch from a black visual indication (reset or fault) to a white visual indication (operational) during flight if the sensing circuits are operational.

Prior to testing the overspeed control system, the operator manually resets the BITE indicator 46 to black. The operator then, in order to test the redundancy monitor itself, actuates the lever of test switch 42 in one direction and momentarily holds it there. The operation of the self test feature is more completely described with reference to FIG. 2.

The overspeed control system is energized to power the redundancy monitor 38 with 28 volts at pin 40H. When the lever of momentary-on switch 42 is moved so as to shunt resistor 51, the voltage at lines P and Q change to 17.12 vdc. This causes comparator 56 to switch states and results in the lighting of indicator lamp 44 through transistor 57 indicating proper operation of monitor 38. Lamp 44 stays lit as long as momentary switch 42 remains switched to shunt out resistor 51, thereby confirming the operational condition of this circuitry.

When the lever of momentary-on switch 42 is moved in the other direction, resistors 60 and 61 are placed in parallel with resistor 52. Resistor 60 has a value of 19.6K and resistor 61 has a value of 3.83K. As a result, when momentary-on switch shunts resistor 52, the voltage at line P drops to 15.25 vdc and line Q drops to 12.45 vdc. With line R at 16.59 vdc, comparator 55 switches state causing lamp 44 to light. Additionally, current flowing through resistors 60 and 61 generates a voltage at line T of 2.03 vdc. This voltage causes current to flow through resistors 62 and 63 which are both valued at 499K. As a result, line V has a voltage value of 1.015 vdc which appears on the plus input of comparator 58. The negative input of comparator 58 has a voltage level of 0.55 vdc derived from line U which is generated by current flowing through resistors 65 and 66 whose values are respectively 100K and 2K ohms. Polarized in this manner, comparator 58 causes current to flow through BITE indicator 46 switching its state from black to white thereby confirming the operational condition of this portion of the circuitry of the monitor 38. Once latched in the white state, the BITE indicator remains there until manually reset.

The way in which the redundancy monitor functions is described with reference to FIG. 2. Zener diode 48 holds the +28 v supply entering pin H of connector 40 to constant reference level for use in the monitor circuitry. Resistors 50, 51 and 52 which are respectively 9.09K, 2K and 14.3K ohms serve as a divider network supplying reference voltages as follows: line P equal to 17.97 volts and line Q equal to 15.76 volts. For the case where the overspeed control system is operating normally, the output signal voltage at pin K of connector 40 will be 16.59 vdc. This signal level passes the 100K ohm isolation resistor 53, since there is no current drain, and appears at the 16.59 vdc value on line R. Comparators 55 and 56, polarized as shown, will then both have a normally high voltage level at line S, since there is little current passing through 20K ohm resistor 54. With line S high the 2N2907 transistor 57 will be cut off and indicator lamp 44 will not be lit. Comparators 55, 56, 58 and 59 in the unit reduced to practice each represent one fourth of an LM139 integrated circuit chip. Comparator 59 has all leads grounded to minimize circuit noise.

Resistor 66 has a value of 470 ohms and zener diode 67 is a type IN5252 thereby allowing a standard 24 volt BITE indicator to be used in conjunction with a type 2N2222A switching transistor 68. Typical values for other components are as follows: resistor 64 equals 20K; resistor 70 equals 10K; capacitor 76 equals 4.7 mfd; diodes 78 and 80 equal IN645; capacitor 82 equals 1.5 mfd and capacitor 84 equals 0.1 mfd. It will be understood that since the four comparators are a quad-chip, the 28 volt supply and ground is only shown as being connected to comparator unit 58 but that pins 3 and 12 of the quad unit supply power to all units.

During engine operation, the two pickups 14 and 16 (See FIG. 1) will be counting the passage of gear teeth and and-gate 18 will generate a square wave output of about 3 volts. This signal enters the monitor circuitry via pin F of connector 40. This signal will pass capacitor 84, be rectified by diode 80, smoothed by capacitor 82 and appear as a positive voltage along line V. If everything functions normally up to the analog and digital channel inputs of the overspeed controller, the voltage at the plus terminal of comparator 58 will be above that on the negative terminal (line U). This state trips the BITE indicator 46 from black to white. However, if something is wrong in the speed sensing circuitry of the overspeed system, there will be no signal input on pin F of connector 40 and the voltage on line V will drop below that on line U. As a result, the BITE indicator will not be able to switch from black to white.

With DC power applied, lamp 44 will light only if something goes wrong in the output of either analog channel 20 or digital channel 22 of the overspeed controller. When something happens to either of these circuits, the output signal voltage entering the redundancy monitor at pin K of connector 40 will change from its normal value of 16.59 vdc. If the output signal level rises above 17.97 vdc, comparator 55 switches state causing lamp 44 to light. If the output signal level drops below 15.76 vdc comparator 56 changes state which also causes lamp 44 to light.

The redundancy monitor thus provides a means for checking after each flight of the aircraft whether the overspeed control system redundant features operated satisfactorily during the last usage without having to start the engine and run it at speeds above 25 percent rated rpm.

What is claimed is:

1. In an overspeed control system for a gas turbine engine including:

a power source; a speed sensing circuit consisting of at least two sensors operatively connected to the gas turbine engine to redundantly generate first signals proportional to the operational speed of said gas turbine engine; gating means connected to receive the first speed signals and transmit a second speed proportional thereto only if all of said redundant signals are present; means to generate a signal indicative of a predetermined overspeed condition; dual comparison circuits, each connected to receive the first speed signals and the predetermined overspeed condition signal, said dual comparison means connected in series to generate an overspeed signal when comparisons, by each of said circuits, of said predetermined signal to at least one of said first speed signals is each indicative of an engine overspeed condition, said dual comparison circuits generating internal signals indicative of proper operation of each of said circuits; and actuating means responsive to the overspeed signal to shut off the fuel supply to the gas turbine engine; a monitor for checking the proper functioning of the overspeed control system during normal operation of the gas turbine engine comprising:

first means connected to the overspeed control system to receive the second speed signal and generate a first monitor signal in response thereto;

speed sensing circuit indicating means connected to receive the first monitor signal and to provide a visual indication of the proper functioning of the speed sensing circuits;

second means connected to the overspeed control system to receive the internal signals of the dual comparison circuits to generate a second monitor signal in response thereto;

comparison circuit indicating means connected to receive the second monitor signal and to provide a visual indication of the proper functioning of the dual comparison circuits; and self test circuitry connected to actuate the first and second monitor signal generating means independent of the overspeed control system to check the proper functioning of the monitor.

2. A monitor for checking the proper functioning of the overspeed control system as described in claim 1 further comprising:

a receptacle connected within the overspeed control system to provide access to the power source, the second speed signal and the internal signal of the dual comparison means; and a connector plug releasably engageable with said receptacle and connected within the monitor to connect said monitor to the power source, the second speed signal and the internal signal of the dual comparison means of the overspeed control system.

3. A monitor for checking the proper functioning of the overspeed control system as described in claim 1 wherein the speed sensing circuit indicating means is an electro-mechanical, manually resettable indicator which is capable of showing two states of visual indication, one indicating proper functioning of the speed sensing circuit in response to the presence of the first monitoring signal and a second indicating a malfunction in response to the absence of the first monitoring signal.

4. A monitor for checking the proper functioning of the overspeed control system as described in claim 1 wherein the comparison circuit indicating means is a lamp connected to light in response to the absence of the second monitor signal.

* * * * *